US010882799B2

(12) United States Patent
Coffey et al.

(10) Patent No.: US 10,882,799 B2
(45) Date of Patent: Jan. 5, 2021

(54) PRIMER FOR FIREARMS AND OTHER MUNITIONS

(71) Applicants: University of Central Florida Research Foundation Inc., Orlando, FL (US); Spectre Materials Sciences, Inc., West Palm Beach, FL (US)

(72) Inventors: Kevin R. Coffey, Oviedo, FL (US); Jonathan Mohler, Vero Beach, FL (US); Timothy Mohler, Palm Beach Gardens, FL (US); Edward Alan Dein, Saint Cloud, FL (US); Daniel Yates, Melbourne, FL (US)

(73) Assignees: SPECTRE MATERIALS SCIENCES, INC., Melbourne, FL (US); UNIVERSITY OF CENTRAL FLORIDA RESEARCH FOUNDATION, INC., Orlando, FL (US)

( * ) Notice: Subject to any disclaimer, the term of this patent is extended or adjusted under 35 U.S.C. 154(b) by 0 days.

(21) Appl. No.: 14/850,902

(22) Filed: Sep. 10, 2015

(65) Prior Publication Data

US 2016/0102030 A1 Apr. 14, 2016

Related U.S. Application Data

(60) Provisional application No. 62/048,765, filed on Sep. 10, 2014, provisional application No. 62/104,737, filed on Jan. 17, 2015.

(51) Int. Cl.

| | |
|---|---|
| ***C06B 33/00*** | (2006.01) |
| ***C06B 45/14*** | (2006.01) |
| ***C06C 9/00*** | (2006.01) |

(52) U.S. Cl.
CPC ..... *C06B 33/00* (2013.01); *C06B 45/14* (2013.01); *C06C 9/00* (2013.01)

(58) Field of Classification Search
None
See application file for complete search history.

(56) References Cited

U.S. PATENT DOCUMENTS 2,652,775 A * 9/1953 Swanson ..... F42B 1/04 102/204
3,610,151 A * 10/1971 Nett ..... F02K 9/95 102/204

(Continued)

OTHER PUBLICATIONS

Detonator, Wikipedia, https://en.wikipedia.org/wiki/Detonator.

(Continued)

*Primary Examiner* — Aileen B Felton
(74) *Attorney, Agent, or Firm* — William F. Lang, IV; Lang Patent Law LLC

(57) ABSTRACT

A primer includes a layered thermite coating comprising alternating layers of metal oxide and reducing metal (thermite) deposited upon a substrate. The layered thermite coating may include a primary ignition portion adjacent to the substrate, and a secondary ignition portion deposited on the primary ignition portion. The alternating thermite layers may be thinner within the primary ignition portion than in the secondary ignition portion. The primary ignition portion is structured for sensitivity to a firing pin strike to the opposite side of the substrate. The secondary ignition portion is structured to burn at a rate that will ignite smokeless powder or other ignitable substances used in munitions.

47 Claims, 6 Drawing Sheets

(56) References Cited

U.S. PATENT DOCUMENTS

| | | | | |
|---|---|---|---|---|
| 3,961,576 | A * | 6/1976 | Montgomery, Jr. | F42B 12/44 102/382 |
| 4,996,922 | A | 3/1991 | Halcomb et al. | |
| 5,266,132 | A * | 11/1993 | Danen | C06B 45/12 149/15 |
| 5,773,748 | A | 6/1998 | Makowiecki et al. | |
| 5,817,970 | A | 10/1998 | Feierlein | |
| 5,854,439 | A | 12/1998 | Almstrum et al. | |
| 6,962,112 | B1 | 11/2005 | Kern | |
| 7,955,451 | B2 | 6/2011 | Hugus et al. | |
| 7,998,290 | B2 | 8/2011 | Sheridan et al. | |
| 8,298,358 | B1 * | 10/2012 | Coffey | C06B 33/00 149/108.2 |
| 8,465,608 | B1 | 6/2013 | Coffey | |
| 2002/0092438 | A1 * | 7/2002 | Makowiecki | C06B 21/0066 102/205 |
| 2007/0099335 | A1 | 5/2007 | Gangopadhyay et al. | |
| 2007/0169862 | A1 | 7/2007 | Hugus et al. | |
| 2008/0028922 | A1 * | 2/2008 | Wilson | F42D 5/04 89/1.13 |
| 2010/0282115 | A1 * | 11/2010 | Sheridan | F42B 12/207 102/491 |
| 2016/0216095 | A1 | 7/2016 | Rami | |

OTHER PUBLICATIONS

Thermite, Wikipedia, https://en.wikipedia.org/wiki/Thermite.

Blobaum, "Deposition and Characterization of a Self-Propagating CuOx/Al Thermite Reaction in a Multilayer Foil Geometry," 94 Journal of Applied Physics 2915 (Sep. 1, 2013).

Kinsey, "Gas Suppression via Copper Interlayers in Magnetron Sputtered Al-Cu2O Multilayers," ACS Applied Materials & Interfaces, 22026, 22027 (2017).

* cited by examiner

FIG. 7
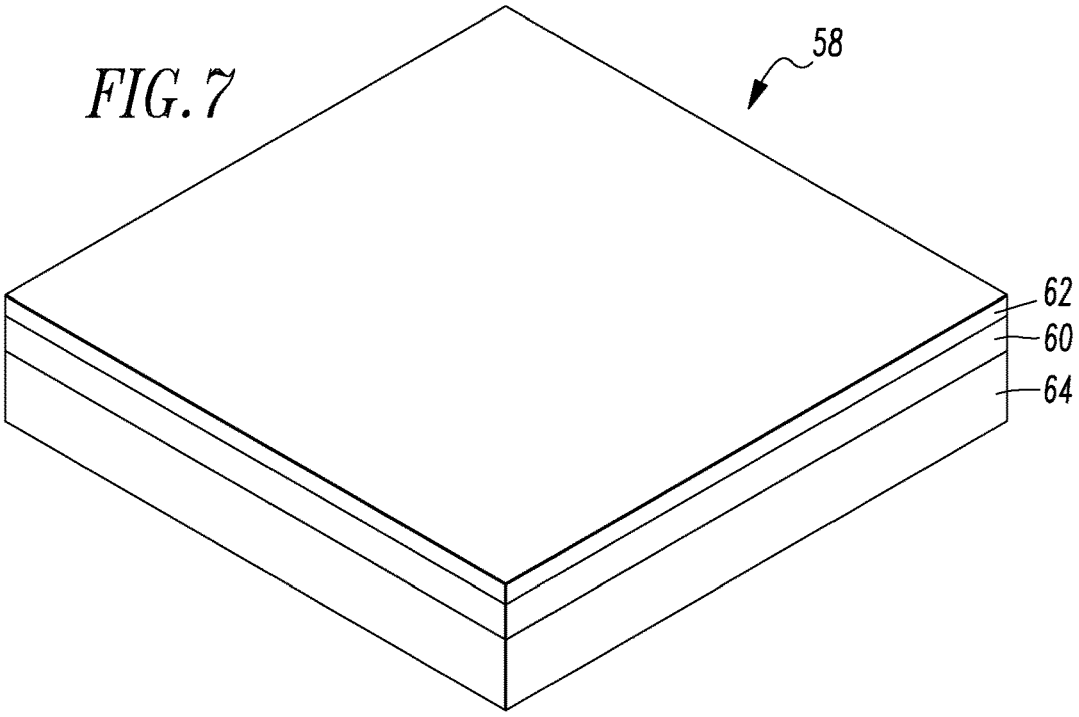
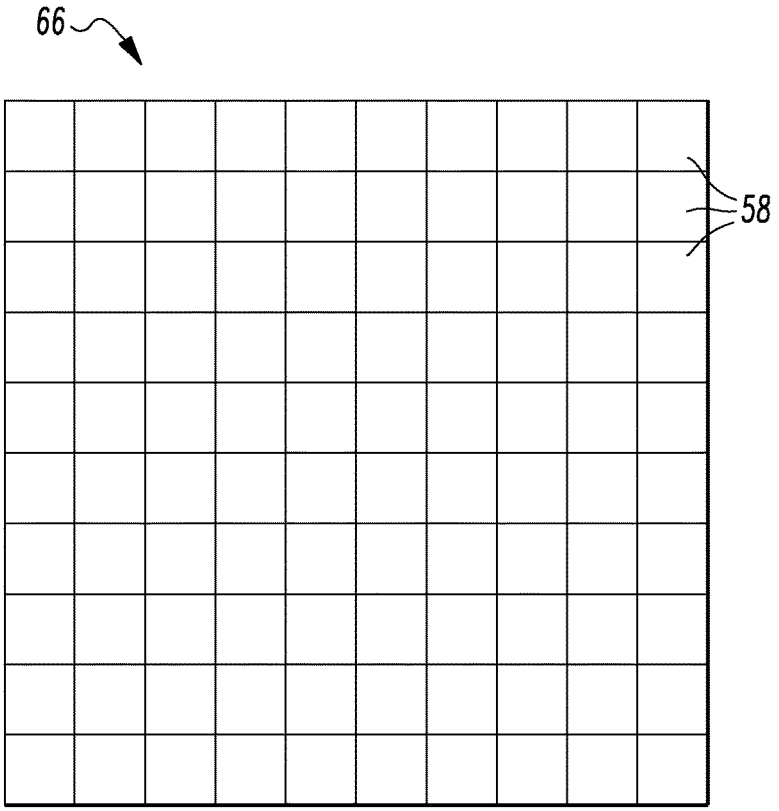
FIG. 8

PRIMER FOR FIREARMS AND OTHER MUNITIONS

CROSS REFERENCE TO RELATED APPLICATION

This application claims the benefit of U.S. provisional patent application Ser. No. 62/048,765, filed Sep. 10, 2014, and entitled "Primer for Firearms and Other Munitions." This application also claims the benefit of U.S. provisional patent application Ser. No. 62/104,737, filed Jan. 17, 2015, and entitled "Primer for Firearms and Other Munitions."

TECHNICAL FIELD

The present invention relates to primers for firearms and other munitions. More specifically, a primer made from layered metal oxide and reducing metal is provided.

BACKGROUND INFORMATION

Cartridges for firearms, as well as other munitions such as larger projectile cartridges and explosives are often ignited by a primer. Presently available primers and detonators are made from a copper or brass alloy cup with a brass anvil and containing lead azide or lead styphnate. When the base of the cup is struck by a firing pin, the priming compound is crushed between the cup's base and the anvil, igniting the primer charge. The burning primer then ignites another flammable substance such as smokeless powder, explosive substances, etc. Lead azide and lead styphnate are hazardous due to their toxicity as well as their highly explosive nature. Additionally, present manufacturing methods are very labor-intensive, with the necessary manual processes raising costs, causing greater difficulty in maintaining quality control.

Energetic materials such as thermite are presently used when highly exothermic reactions are needed. Uses include cutting, welding, purification of metal ores, and enhancing the effects of high explosives. A thermite reaction occurs between a metal oxide and a reducing metal. Examples of metal oxides include $La_2O_3$, AgO, $ThO_2$, SrO, $ZrO_2$, $UO_2$, BaO, $CeO_2$, $B_2O_3$, $SiO_2$, $V_2O_5$, $Ta_2O_5$, NiO, $Ni_2O_3$, $Cr_2O_3$, $MoO_3$, $P_2O_5$, $SnO_2$, $WO_2$, $WO_3$, $Fe_3O_4$, CoO, $Co_3O_4$, $Sb_2O_3$, PbO, $Fe_2O_3$, $Bi_2O_3$, $MnO_2$, $Cu_2O$, and CuO. Example reducing metals include Al, Zr, Th, Ca, Mg, U, B, Ce, Be, Ti, Ta, Hf, and La. The reducing metal may also be in the form of an alloy or intermetallic compound of the above-listed metals.

There is a need for a primer made from materials that do not share the toxicity of lead. There is a further need for a primer made from materials that lend themselves to automated processes. Another need exists for a primer made from energetic materials that lends itself to ignition through a strike by a firing pin, but which otherwise benefits from the stability of thermite.

SUMMARY

The above needs are met by a thermite primer. The primer has a substrate having a deposition surface and a rear surface. Alternating layers of metal oxide and reducing metal are deposited upon the substrate. The alternating layers of metal oxide and reducing metal are structured to react with each other in response to an impact applied to the rear face of the substrate.

A method of making a firearm primer is also provided. The method comprises providing a substrate having two sides, and depositing alternating layers of metal oxide and reducing metal on one side of the substrate. At least some of the layers of metal oxide and reducing metal are deposited to a sufficiently thin thickness to permit ignition of the primer by striking the uncoated side of the substrate.

These and other aspects of the invention will become more apparent through the following description and drawings.

BRIEF DESCRIPTION OF THE DRAWINGS

FIG. 7 is a perspective view of another primer.

FIG. 8 is a top plan view of a sheet from which individual primers of FIG. 7 are made.

Like reference characters denote like elements throughout the drawings.

DETAILED DESCRIPTION

Figure 1:
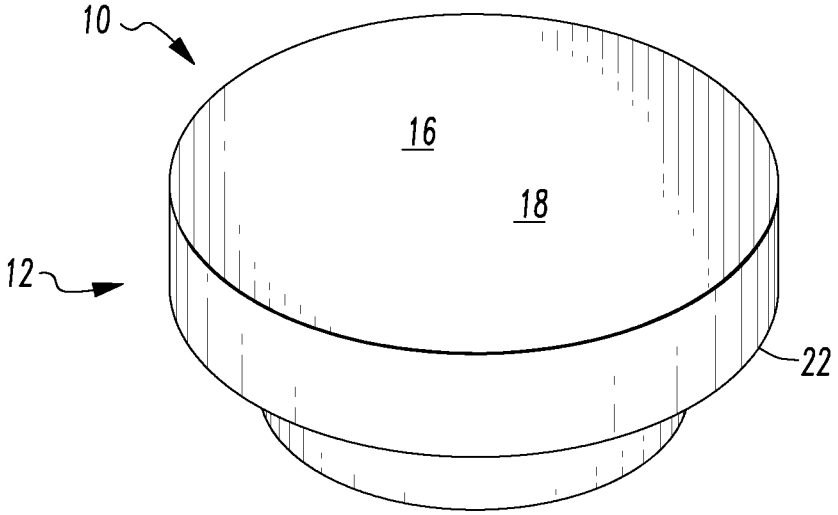
FIG. 1 is a perspective top view of a primer.
Figure 2:
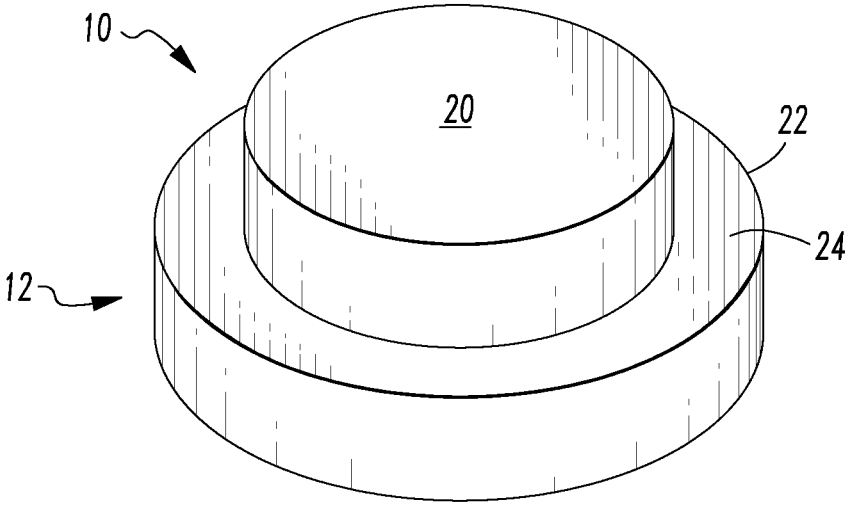
FIG. 2 is a perspective bottom view of a primer of FIG. 1.

Referring to FIGS. 1-2, a primer 10 is shown. The primer 10 includes a substrate 12, a layered thermite coating 14, and a passivation coating 16.

The substrate 12 in the illustrated example is a brass or copper disk having a deposition surface 18 upon which the layered thermite coating 14 is deposited, and a rear surface 20. The substrate 12 is a sufficiently thin so that a firing pin strike to the rear surface 20 will ignite the layered thermite coating 14 as described below, but is sufficiently thick for ease of manufacturing the primer 10 as well as securing the primer 10 within a cartridge case, munition, modified primer cup, or other location as described below. A preferred substrate thickness is about 0.005 inch to about 0.1 inch, and is more preferably about 0.01 to about 0.025 inch. The illustrated example of a substrate 14 includes a beveled outer edge 22 defining a ledge 24, with the deposition surface 18 having a larger diameter than the rear surface 20.

Figure 3:
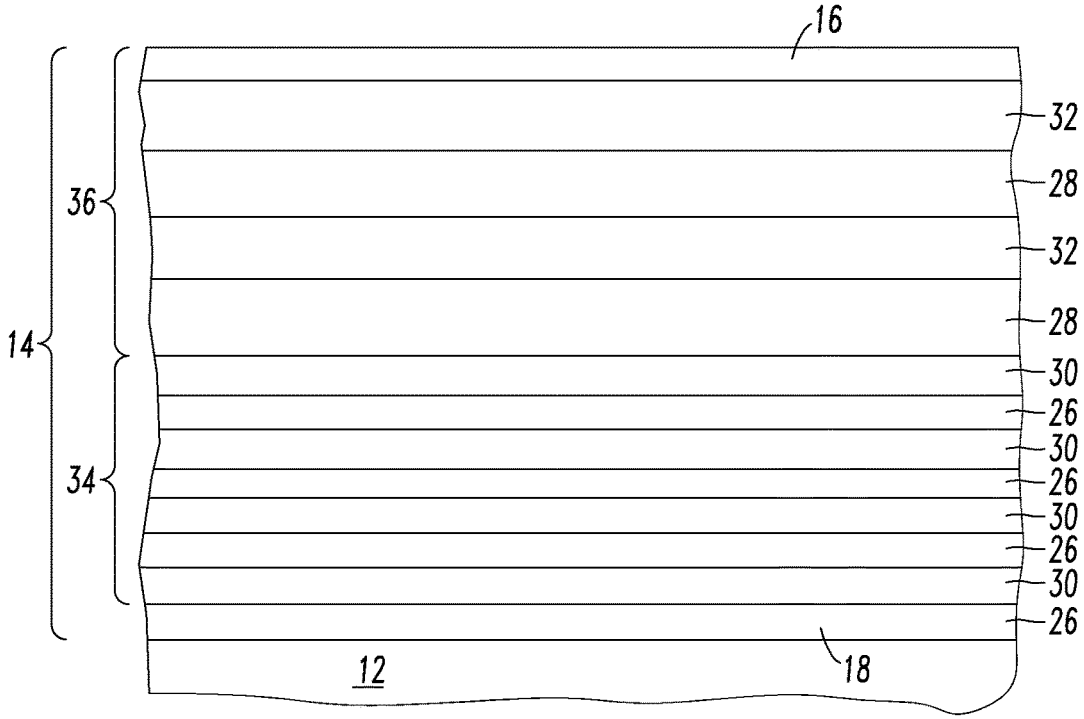
FIG. 3 is a sectional, side elevational view of a layered thermite structure and passivation coating for a primer of FIG. 1.

Referring to FIG. 3, the layered thermite coating 14 includes alternating layers of metal oxide and reducing metal (with only a small number of layers illustrated for clarity). Examples of metal oxides include $La_2O_3$, AgO, $ThO_2$, SrO, $ZrO_2$, $UO_2$, BaO, $CeO_2$, $B_2O_3$, $SiO_2$, $V_2O_5$, $Ta_2O_5$, NiO, $Ni_2O_3$, $Cr_2O_3$, $MoO_3$, $P_2O_5$, $SnO_2$, $WO_2$, $WO_3$, $Fe_3O_4$, CoO, $Co_3O_4$, $Sb_2O_3$, PbO, $Fe_2O_3$, $Bi_2O_3$, $MnO_2$, $Cu_2O$, and CuO. Example reducing metals include Al, Zr, Th, Ca, Mg, U, B, Ce, Be, Ti, Ta, Hf, and La. The metal oxide and reducing metal are preferably selected to resist abrasion or other damage to a barrel of a firearm with which a cartridge containing the primer is used by avoiding reaction products which could potentially cause such damage. A preferred combination of metal oxide and reducing metal is cupric oxide and magnesium.

The thickness of each metal oxide layer 26, 28 and reducing metal layer 30, 32 are determined to ensure that the proportions of metal oxide and reducing metal are such so that both will be substantially consumed by the exothermic reaction. As one example, in the case of a metal oxide layer 26, 32 made from CuO and reducing metal layer 30, 32 made from Mg, the chemical reaction is $CuO+Mg \rightarrow Cu+MgO+heat$. The reaction therefore requires one mole of CuO, weighing 79.5454 grams/mole, for every one mole of Mg, weighing 24.305 grams/mole. CuO has a density of 6.315 g/cm$^3$, and magnesium has a density of 1.74 g/cm$^3$. Therefore, the volume of CuO required for every mole is 12.596 cm$^3$. Similarly, the volume of Mg required for every mole is 13.968 cm$^3$. Therefore, within the illustrated example, each layer of metal oxide 26, 28 is about the same thickness or slightly thinner than the corresponding layer of reducing metal 30, 32. If other metal oxides and reducing metals are selected, then the relative thickness of the metal oxide 26, 28 and reducing metal 30, 32 can be similarly determined.

The illustrated example of a layered thermite coating 14 is divided into an initial ignition portion 34 that is deposited directly onto the substrate 12, and a secondary ignition portion 36 that is deposited onto the initial ignition portion 34. The illustrated example of the initial ignition portion 34 includes layers of metal oxide 26 and reducing metal 30 that are thinner than the layers of metal oxide 28 and reducing metal 32 within the secondary ignition portion 36. In the illustrated example, each metal oxide 26 and reducing metal 30 pair of layers are preferably between about 20 nm and about 100 nm thick, with the illustrated example having pairs of layers that are about 84 nm thick. In the illustrated example, each pair of metal oxide 28 and reducing metal 32 layers are thicker than about 100 nm thick. Thinner layers result in more rapid burning and easier ignition, while thicker layers provide a slower burn rate. The thinner layers 26, 30 within the initial ignition portion 34 are more sensitive to physical impacts, thereby facilitating ignition in response to a firing pin strike to the rear surface 20 of the substrate 12, and ignite the secondary ignition portion 36. The thicker layers 28, 32 within the secondary ignition portion 36 burn more slowly, ensuring ignition of the smokeless powder, explosive, or other desired ignitable substance. The total thickness of the illustrated examples of the layered thermite coating 14 is between about 25 μm and about 1,000 μm.

Figure 11:
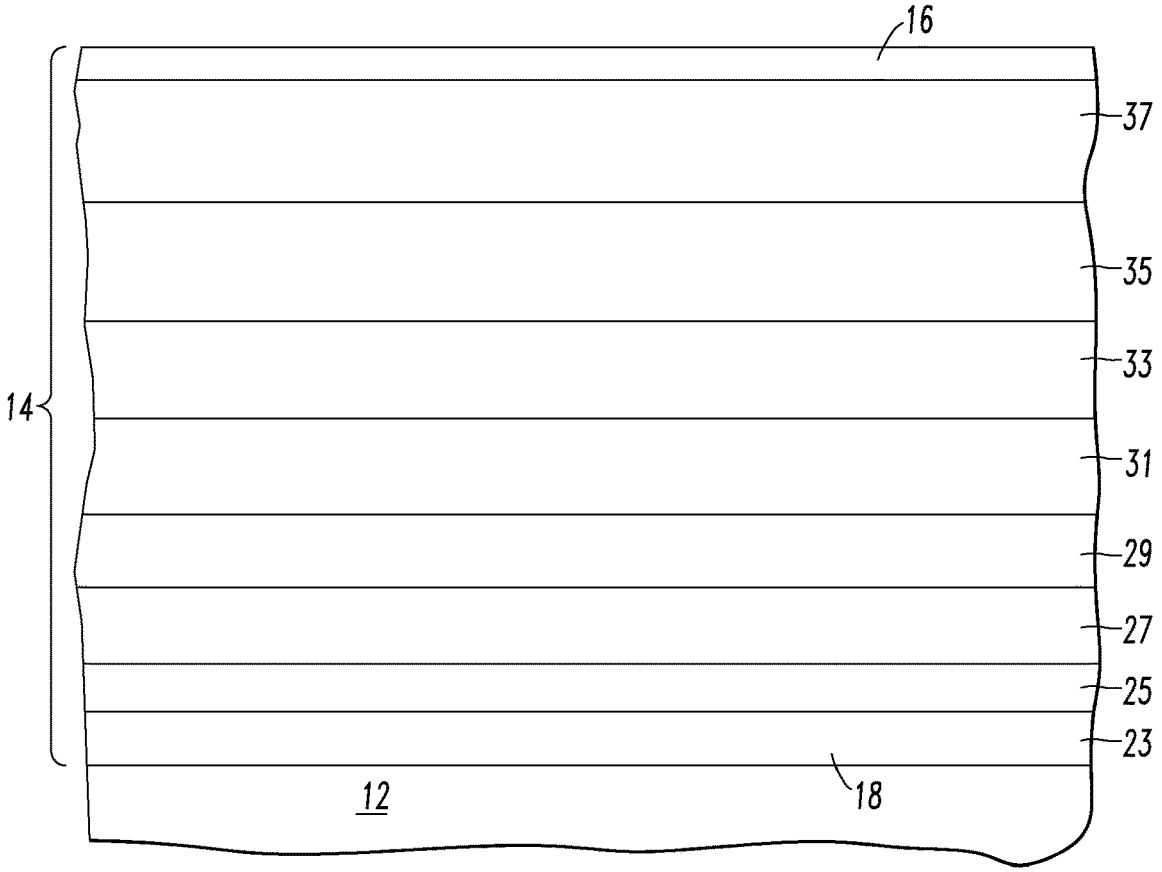
FIG. 11 is a sectional, side elevational view of an alternative layered thermite structure and passivation coating for a primer of FIG. 1.

The illustrated example of the thermite coating 14 shows a generally uniform thickness for all layers 26, 30 within the initial ignition portion 34. Similarly, a generally uniform thickness is shown within the layers 28, 32 within the secondary ignition portion 36. Other examples may include metal oxide and reducing metal layers having differing thicknesses. For example, FIG. 11 shows a primer having thermite layers that increase generally proportionally with the distance of the layer from the substrate 12 (with only a small number of layers shown for clarity). Layers 23 and 25, which are close to the substrate 12, have a smaller thickness, for example, between about 20 nm and about 100 nm thick. Layers 27 and 29 have increased thickness. Layers 31 and 33, farther still from the substrate 12, have greater thickness than layers 27 and 29. Layers 35 and 37, adjacent to the passivation coating 16 and farthest from the substrate 12, are the thickest layers, and are thicker than about 100 nm thick. As before, the total thickness of the illustrated examples of the layered thermite coating is between about 25 μm and about 1,000 μm. Such a thermite coating would provide essentially the same advantage of rapid ignition close to the substrate 12, and relatively slower burning farther from the substrate 12 and closer to the smokeless powder, explosive, or other ignitable substance. With such gradually increasing thickness, a clear boundary between an initial ignition portion and secondary ignition portion may not exist, and a definite boundary is not essential to the functioning of the invention.

As another example, all layers of metal oxide and reducing metal may be less than about 100 nm thick, and the time required to consume all layers of metal oxide and reducing metal may be increased sufficiently to ignite conventional propellants and explosives by simply increasing the number of layers of metal oxide and reducing metal.

Other examples of the layered thermite coating 14 may include layers 26, 28, 30, 32, or layers 23, 25, 27, 29, 31, 33, 35, 37, that are deposited under different temperatures, so that each layer is deposited under a temperature which is either sufficiently higher or sufficiently lower than the adjacent layers to induce thermal expansion and contraction stresses within the layered thermite coating 14 once temperature is equalized within the layered thermite coating. Such expansion and contraction stresses are anticipated to result in increased sensitivity to ignition through a physical impact.

Additives may be included within the thermite layers. For example, zirconium particles may be included to aid in igniting the smokeless powder or other ignitable substance. Micanite may be included as a gas producer.

A passivation layer 16 covers the layered thermite coating 14, protecting the metal oxide and reducing metal within the layered thermite coating 14. One example of a passivation layer 16 is silicon nitride. Alternative passivation layers 16 can be made from reactive metals that self-passivate, for example, aluminum or chromium. When oxide forms on the surface of such metals, the oxide is self-sealing, so that oxide formation stops once the exposed surface of the metal is completely covered with oxide.

Figure 4:
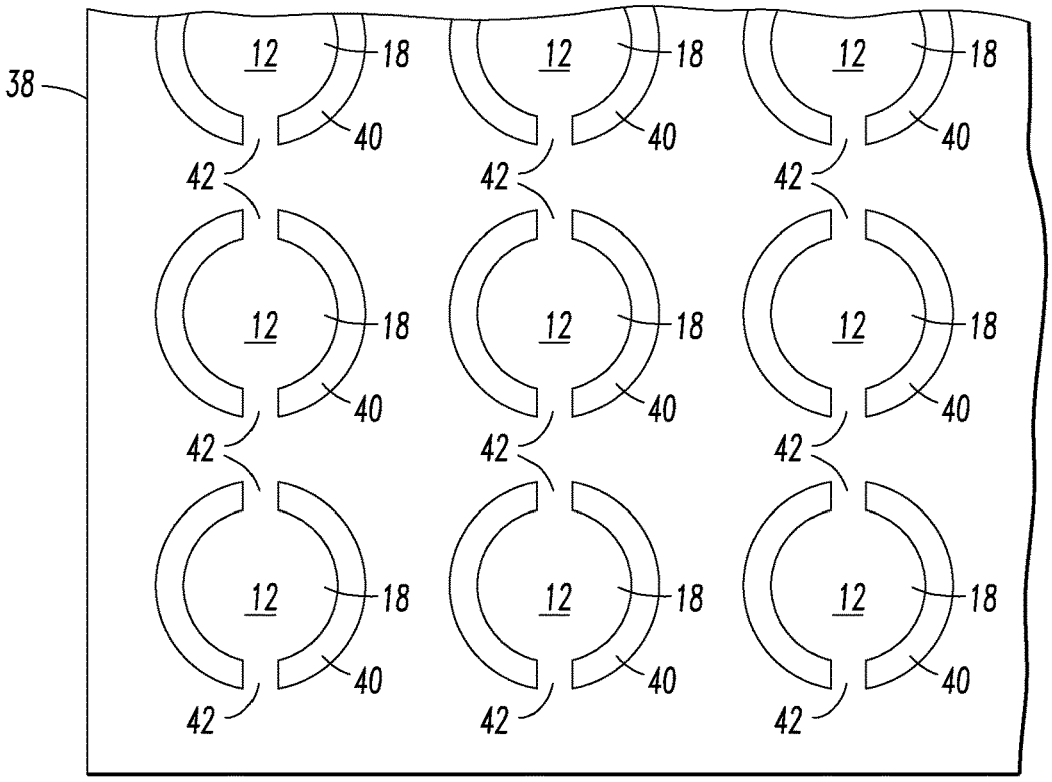
FIG. 4 is a top plan view of a substrate sheet from which individual primers of FIG. 1 are made.
Figure 5:
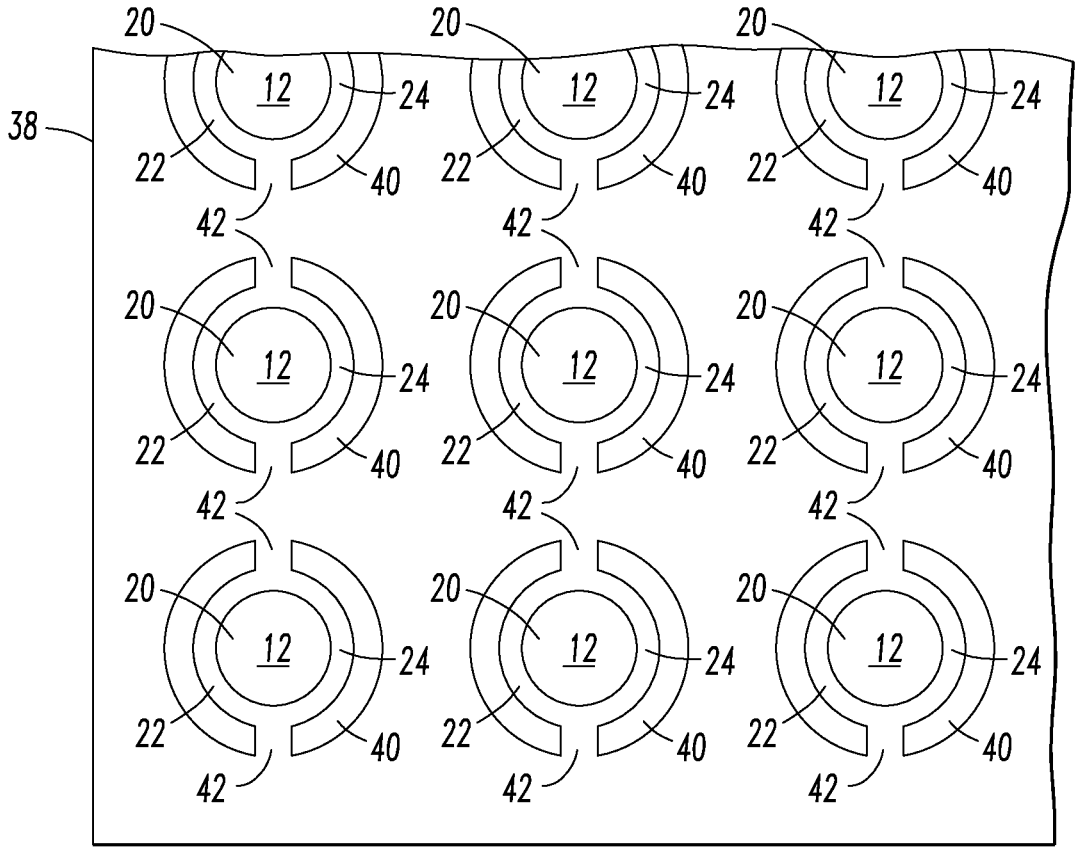
FIG. 5 is a bottom plan view of a substrate sheet from which individual primers of FIG. 1 are made.

Referring to FIGS. 4-5, multiple examples of the primer 10 can be manufactured simultaneously by beginning with a large substrate sheet 38, which may be supplied in sheet or roll form. Individual substrates 12 can be cut into the sheet 38. The beveled edge 22 can be cut first, so that the substrates 12 have maximized support from the sheet 38 during this cutting operation. Perforations 40 may then be cut around the periphery of the substrates 12, so that the individual substrates 12 are retained within the sheet 38 by thin, easily broken tabs 42. Next, referring to FIGS. 3-5, individual layered thermite coatings 14 and passivation layers 16 can be deposited on the sheets 38. A layered thermite coating 14 can be made by sputtering or physical vapor deposition. In particular, high power impulse magnetron sputtering can rapidly produce the thermite coating 14. As another option, specific manufacturing methods described in U.S. Pat. No. 8,298,358, issued to Kevin R. Coffey et al. on Oct. 30, 2012, and U.S. Pat. No. 8,465,608, issued to Kevin R. Coffey et al. on Jun. 18, 2013, are suited to depositing the alternating metal oxide and reducing metal layers in a manner that resists the formation of oxides between the alternating layers, and the entire disclosure of both patents is expressly incorporated herein by reference. Dr. Coffey's methods permit the interface between alternating metal oxide and reducing metal layers to be either substantially free of metal oxide, or if reducing metal oxides are present, then the reducing metal oxide layer forming the interface will have a thickness of less than about 2 nm. Depositing individual layers of the metal oxide and reducing metal under elevated and/or reduced temperatures can optionally be used to create expansion/contraction stresses with respect to other layers within the layered thermite coating 14 as these layers return to room temperature, thereby enhancing the sensitivity of primers 10 to firing pin strikes. If desired, lithography can be used to remove undesired portions of each layer in regions of the sheet 38 surrounding the substrates 12, leaving only that portion which will become part of a primer 10. The remainder of the sheet 38 can then be recycled.

Once all layers of metal oxide 26, 28 and reducing metal 30, 32 are deposited and all layered thermite coatings 14 are formed, the passivation layers 16 may be deposited onto the layered thermite coatings 14 using any of the above-described methods. Next, the individual primers 10 may be separated from the substrate sheet 38 by gently cutting or breaking the tabs 42 holding the individual substrates 12 within the sheet 38. Because the bulk of the cutting was performed prior to depositing the thermite coating 14, the primers 10 can be separated from the sheet 38 without igniting the primers 10. The primers 10 are now ready for installation into a desired cartridge or munition.

Figure 6:
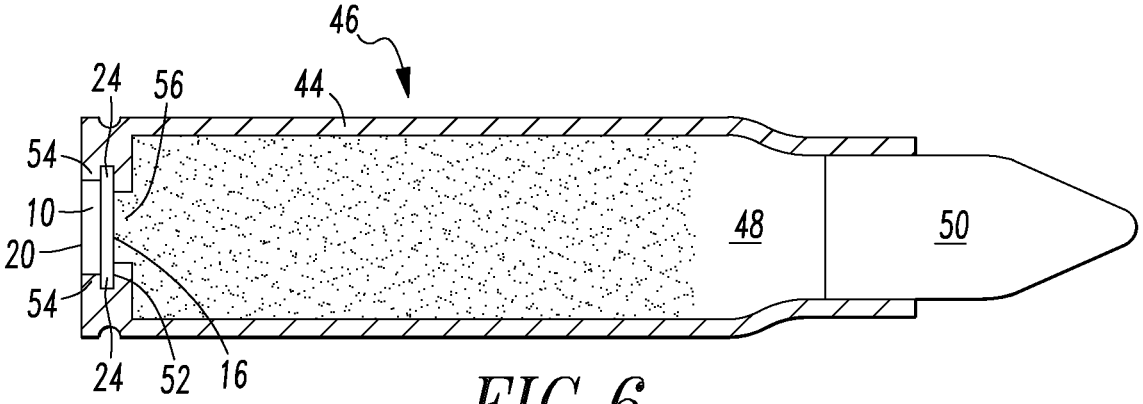
FIG. 6 is a cutaway side elevational view of a primer of FIG. 1 installed within a cartridge casing.

Referring to FIG. 6, a primer 10 is installed within the casing 44 of a firearm cartridge 46. The casing 44 contains smokeless powder 48 therein, and retains a bullet 50 at its forward end. The casing 44 defines a primer opening 52 that corresponds to the shape of the primer 10, and includes a protrusion 54 that is structured to engage the shelf 24 to retain the primer 10. A flash hole 56 provides a means for the smokeless powder 48 to contact the passivation coating 16 of the primer 10. In the illustrated example, the flash hole 56 is relatively large in diameter to maximize contact between the primer 10 and powder 48, but smaller in diameter than the rear face 20 to resist improper installation of the primer 10 within the casing 44. When a firing pin strikes the rear surface 20, the substrate 12 is dented inward, and the initial ignition section 34 of the primer is ignited by the firing pin strike. The burning of the initial ignition section 34 ignites the secondary ignition section 36, which burns for a sufficiently long period of time to ignite the smokeless powder 48. The burning of smokeless powder 48 creates a high pressure, expanding gas, driving the bullet 50 forward.

As another option, a square primer 58 may be used as shown in FIG. 7. The square primer 58 is essentially identical to the round primer 10 except for its shape. A square primer may be made by depositing a thermite coating 60 and passivation layer 62 onto a substrate 64, with the substrate 64 being in the form of a thin brass sheet 66 (FIG. 8), which may be supplied in flat or in roll form. The thermite coating 60 is substantially the same as the thermite coating 14 described above and may utilize a structure such as the examples illustrated in FIG. 3 or 11, having multiple layers of metal oxide and reducing metal. Some examples of the thermite coating 60 may include thinner layers of metal oxide and reducing metal in close proximity to the substrate 64, and thicker layers of metal oxide and reducing metal in portions of the thermite coating that are farther from the substrate 64. The thermite coating 60 may include a clearly defined primary ignition portion 34 and secondary ignition portion 36 as shown in FIG. 3. Alternatively, the thickness of the layers of metal oxide and reducing metal may gradually increase with increasing distance from the substrate 64 as shown in FIG. 11.

Figure 9:
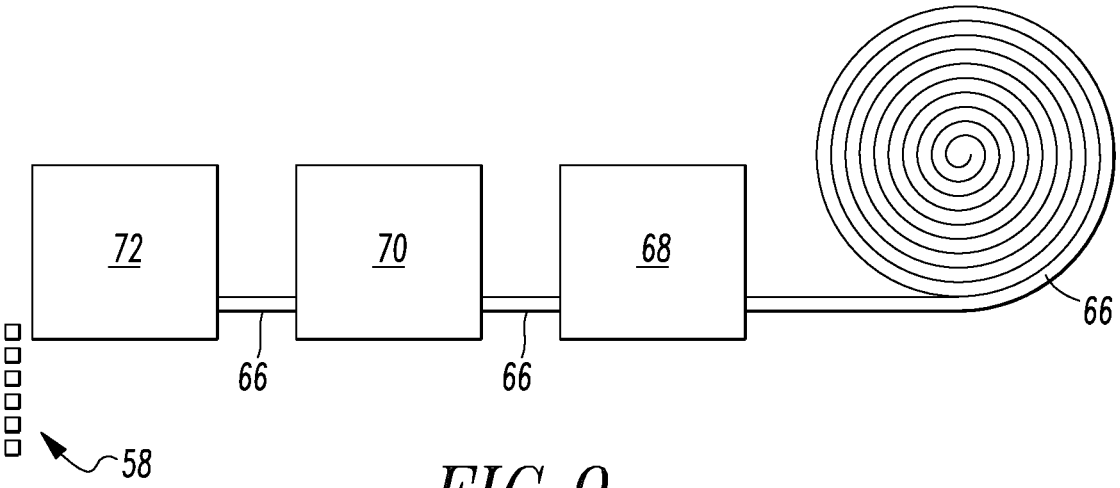
FIG. 9 is a diagrammatic view of a process for producing primers of FIG. 7.

An example of a procedure for making primers 58 is illustrated in FIG. 9. The substrate 66 is supplied in the form of rolled brass sheet. The thickness of the rolled brass sheet is about 0.005 inch to about 0.05 thick, and more preferably about 0.01 inch to about 0.0125 inch. As the substrate 66 is unrolled, it is passed through any deposition apparatus 68. The deposition apparatus 68 can be structured to perform sputtering, for example, high power impulse magnetron sputtering, or physical vapor deposition. The deposition apparatus 68 can also be structured to perform the methods described in U.S. Pat. No. 8,298,358, issued to Kevin R. Coffey et al. on Oct. 30, 2012, and U.S. Pat. No. 8,465,608, issued to Kevin R. Coffey et al. on Jun. 18, 2013, both of which are expressly incorporated herein by reference in their entirety. The deposition apparatus 68 may optionally deposit individual layers of the metal oxide and reducing metal under elevated and/or reduced temperatures to create expansion/contraction stresses with respect to other layers within the layered thermite coating 14 as these layers return to room temperature, thereby enhancing the sensitivity of primers 58 to firing pin strikes.

Next, the passivation layer 16 is deposited on the layered thermite coating 14. In the illustrated example, this step is performed by the deposition apparatus 70, which may be any conventional deposition apparatus performing any of the deposition procedures described above. In other examples, this step could potentially be performed by the same device that deposits the layered thermite coating 14.

Once the thermite and passivation layers are deposited, the substrate can be cut to form the individual primers by a cutting device 72. The inventors have found that gentle cutting methods will not ignite the thermite 14.

The illustrated example of a square primer 58 does not include the beveled edge of the illustrated example of a round primer, although it is entirely possible to supply a square primer with a beveled edge or round primer without a beveled edge, or any other shape primer with or without a beveled edge.

Figure 10:
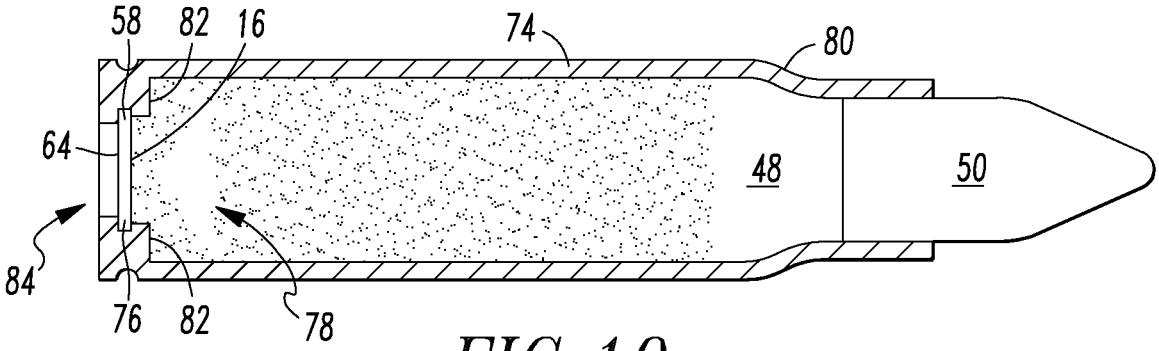
FIG. 10 is a cutaway side elevational view of a primer of FIG. 7 installed within a cartridge casing.

Once the individual primers are cut, they may be installed into an appropriate casing 74 as shown in FIG. 10. The casing 74 contains smokeless powder 48 therein, and retains a bullet 50 at its forward end. The casing 44 defines a primer opening 76 that corresponds to the shape of the primer 58. A flash hole 78 not only provides a means for the smokeless powder 48 to contact the passivation coating 16 of the primer 58, but also provides the means by which the primer 58 is installed within the casing 74. Tabs or lip 82 retain the primer 58 within the primer opening 76. A firing pin opening 84 is defined within the rear face of the casing 74, permitting a firing pin to contact the primer 58 but resisting separation of the primer 58 from the casing 74. When a firing pin strikes the substrate 64, the substrate 64 is dented inward, and the layered thermite coating 14 is ignited by the firing pin strike. Ignition of the thermite coating 14 ignites the smokeless powder 48. The burning of smokeless powder 48 creates a high pressure, expanding gas, driving the bullet 50 forward.

Figure 12:
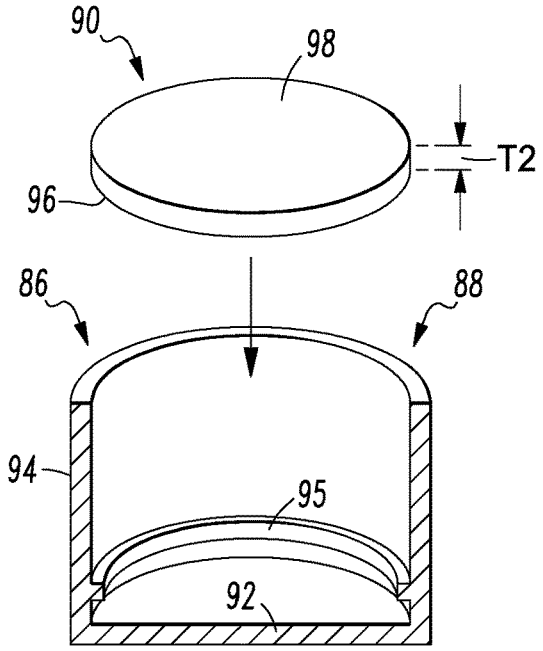
FIG. 12 is a partially exploded, sectional view of another primer.
Figure 13:
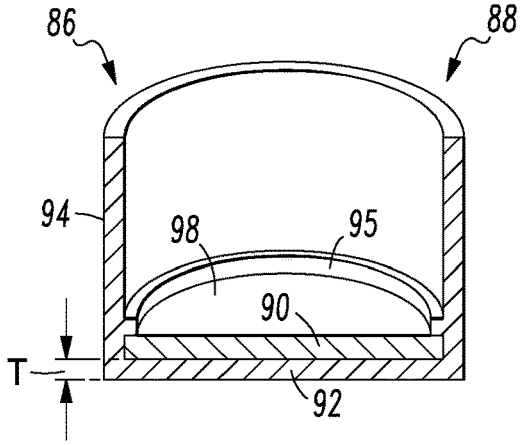
FIG. 13 is a sectional view of the primer of FIG. 12.

FIGS. 12-13 illustrate another example of a primer 86. The primer 86 is designed to fit a conventional primer opening of a conventional cartridge casing in a manner well known in the art of firearms ammunition. The primer 86 includes a cup 88 that is structured to retain a disk 90 therein. The cup 88 has exterior dimensions and an external configuration that is substantially similar to the dimensions and configuration of a conventional primer, and includes a base 92 having a thickness T and a side wall 94 extending upward therefrom. The thickness T is about 0.005 inch to about 0.05 thick, and more preferably about 0.01 inch to about 0.0125 inch. One or more retaining tabs or lip 95 extend inward from the side wall 94. The disk 90 includes a base 96 having a thermite coating 98 consisting of a layered sequence of metal oxide and reducing metal that may have any configuration described above. Some examples of the thermite coating 98 will be as illustrated in FIG. 3 or 11. The primer 86 may be made, including application of the thermite coating 98 to the base 96, using any of the above-described methods, and may be made with or without a beveled edge.

The base 96 has a thickness T2. The thickness T2 is about 0.005 inch to about 0.05 thick, and more preferably about 0.01 inch to about 0.0125 inch. After the thermite coating 98 is applied to the base 96, the base 96 is inserted into the cup 88, with the thermite coating 98 facing away from the base 96. The disk 90 may be snapped into place, and retained abutting the base 92 by the lip 95. The primer 86 may then be installed within a conventional cartridge casing in a manner that is well known in the art of firearms ammunition. The sum of the thicknesses T and T2 is within the same thickness range as the substrates 12 and 66 described above, which is sufficiently thin so that a primer strike to the base 92 from a conventional firearm firing pin will deform the base 92 and base 96 sufficiently to ignite the thermite coating 98, thus igniting the propellant within the cartridge casing.

Although the illustrated examples are for a firearm cartridge, the primers 10, 58, 86 can be used for a larger projectile cartridge such as those for artillery, or for other munitions such as hand grenades and other explosives that utilize a primer as part of their detonation mechanism.

The present invention therefore provides a primer made from materials that do not have the toxicity or other safety issues of conventional primers. The primers are easily manufactured by methods that lend themselves to automation. The primer provides at least the reliability of conventional primers while also taking advantage of the stability of thermite. By adjusting the thickness of the thermite layers within the primary and secondary ignition portions, as well as by the optional creation of expansion/contraction stresses, the sensitivity of the primer can be adjusted, and tailored to specific applications. The primer is useful not only for firearm cartridges, but also for other projectiles such as artillery, grenades, and other explosives and munitions. One example of the primer will fit within a space designed for a conventional primer.

A variety of modifications to the above-described embodiments will be apparent to those skilled in the art from this disclosure. For example, the shape of the primer may be round, square, rectangular, or have an entirely different shape, with or without a beveled edge, or with the beveled edge on either side of the primer. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A primer, comprising:

a substrate having a deposition surface and a rear surface, the substrate being a malleable metal that is structured to be dented upon impact by a conventional firing pin for a conventional firearm;

alternating layers of copper oxide and magnesium deposited upon the substrate, the alternating layers of copper oxide and magnesium being structured to react with each other in response to an impact applied to the rear surface of the substrate; and an interface between each copper oxide layer and adjacent magnesium layer, the interface being a magnesium oxide layer that is sufficiently thin so that most of the interface is non-measurable using high resolution transmission electron microscope detection.

2. The primer according to claim 1, wherein:

each of the layers of copper oxide and magnesium defines a thickness; and the thickness of at least some of the layers of copper oxide and magnesium are sufficiently thin so that the copper oxide and magnesium with react with each other in response to an impact applied to the rear surface of the substrate.

3. The primer according to claim 2, wherein the thickness of at least some of the layers of copper oxide and magnesium is between about 20 nm and about 100 nm.

4. A primer, comprising:

a substrate having a deposition surface and a rear surface, the substrate being structured to be dented upon impact by a conventional firing pin for a conventional firearm; and alternating layers of copper oxide and magnesium deposited upon the substrate, each of the layers of copper oxide and magnesium defining a thickness, the thickness of at least some of the layers of copper oxide and magnesium being sufficiently thin so that the copper oxide and magnesium with react with each other in response to an impact applied to the rear surface of the substrate, the thicknesses of the layers of copper oxide and magnesium that are in closer proximity to the substrate being smaller than the thicknesses of layers of copper oxide and magnesium that are farther from the substrate.

5. The primer according to claim 4, wherein the layers of copper oxide and magnesium further comprise:

a primary ignition portion comprising layers of copper oxide and magnesium in closer proximity to the substrate; and a secondary ignition portion comprising layers of copper oxide and magnesium that are farther from the substrate than the primary ignition portion, the thickness of each of the layers of copper oxide and magnesium within the secondary ignition portion being greater than the thickness of each of the layers of copper oxide and magnesium within the primary ignition portion.

6. The primer according to claim 4, wherein the thickness of each layer is generally proportional to a distance between each layer and the substrate.

7. A primer, comprising:

a substrate having a deposition surface and a rear surface, the substrate being structured to be dented upon impact by a conventional firing pin for a conventional firearm; and alternating layers of copper oxide and magnesium deposited upon the substrate, at least some of the alternating layers of copper oxide and magnesium having expansion or contraction stresses therebetween, the alternating layers of copper oxide and magnesium being structured to react with each other in response to an impact applied to the rear surface of the substrate.

8. The primer according to claim 1, further comprising a passivation layer covering the layers of copper oxide and magnesium.

9. The primer according to claim 1, further comprising zirconium within the layers of copper oxide and magnesium.

10. The primer according to claim 1, further comprising micanite within the layers of copper oxide and magnesium.

11. A primer, comprising:

a substrate having a deposition surface and a rear surface, the substrate having a beveled edge defining a shelf extending around a periphery of the primer, the substrate being structured to be dented upon impact by a conventional firing pin for a conventional firearm; and alternating layers of copper oxide and magnesium deposited upon the substrate, the alternating layers of copper oxide and magnesium being structured to react with each other in response to an impact applied to the rear surface of the substrate.

12. A primer, comprising:

a substrate having a deposition surface and a rear surface, the substrate being structured to be dented upon impact by a conventional firing pin for a conventional firearm;

alternating layers of metal oxide and reducing metal deposited upon the substrate, the alternating layers of metal oxide and reducing metal being structured to react with each other in response to an impact applied to the rear surface of the substrate; and each of the layers of metal oxide and reducing metal defining a thickness, the thicknesses of the layers of metal oxide and reducing metal that are in closer proximity to the substrate being smaller than the thicknesses of layers of metal oxide and reducing metal that are farther from the substrate.

13. The primer according to claim 1, wherein:

the thickness of at least some of the layers of metal oxide and reducing metal are sufficiently thin so that the metal oxide and reducing metal with react with each other in response to an impact applied to the rear surface of the substrate.

14. The primer according to claim 13, wherein the thickness of at least some of the layers of metal oxide and reducing metal is between about 20 nm and about 100 nm.

15. The primer according to claim 12, wherein the layers of metal oxide and reducing metal further comprise:

a primary ignition portion comprising layers of metal oxide and reducing metal in closer proximity to the substrate; and a secondary ignition portion comprising layers of metal oxide and reducing metal that are farther from the substrate than the primary ignition portion, the thickness of each of the layers of metal oxide and reducing metal within the secondary ignition portion being greater than the thickness of each of the layers of metal oxide and reducing metal within the primary ignition portion.

16. The primer according to claim 12, wherein the thickness of each layer is generally proportional to a distance between each layer and the substrate.

17. The primer according to claim 12, further comprising expansion or contraction stresses between at least some layers of metal oxide and reducing metal.

18. The primer according to claim 12, further comprising a passivation layer covering the layers of metal oxide and reducing metal.

19. The primer according to claim 12, further comprising a beveled edge defining a shelf extending around a periphery of the primer.

20. The primer according to claim 12, further comprising an interface between each metal oxide layer and adjacent reducing metal layer, the interface being either substantially free of metal oxide, or the interface being a reducing metal oxide layer having a thickness of less than 2 nm.

21. A primer, comprising:

a substrate having a deposition surface and a rear surface, the substrate being a malleable metal that is structured to be dented upon impact by a conventional firing pin for a conventional firearm;

alternating layers of metal oxide and reducing metal deposited upon the substrate;

an interface between each metal oxide layer and adjacent reducing metal layer, the interface being a reducing metal oxide layer that is sufficiently thin so that most of the interface is non-measurable using high resolution transmission electron microscope detection; and the alternating layers of metal oxide and reducing metal being structured to react with each other in response to an impact applied to the rear surface of the substrate.

22. The primer according to claim 21, wherein:

each of the layers of metal oxide and reducing metal defines a thickness; and the thickness of at least some of the layers of metal oxide and reducing metal are sufficiently thin so that the metal oxide and reducing metal with react with each other in response to an impact applied to the rear surface of the substrate.

23. The primer according to claim 22, wherein the thickness of at least some of the layers of metal oxide and reducing metal is between about 20 nm and about 100 nm.

24. A primer, comprising:

a substrate having a deposition surface and a rear surface, the substrate being structured to be dented upon impact by a conventional firing pin for a conventional firearm;

alternating layers of metal oxide and reducing metal deposited upon the substrate, each of the layers of metal oxide and reducing metal defines a thickness, the thickness of at least some of the layers of metal oxide and reducing metal being sufficiently thin so that the metal oxide and reducing metal with react with each other in response to an impact applied to the rear surface of the substrate, the thicknesses of the layers of metal oxide and reducing metal that are in closer proximity to the substrate being smaller than the thicknesses of layers of metal oxide and reducing metal that are farther from the substrate;

an interface between each metal oxide layer and adjacent reducing metal layer, the interface being either substantially free of metal oxide, or the interface being a reducing metal oxide layer having a thickness of less than 2 nm; and the alternating layers of metal oxide and reducing metal being structured to react with each other in response to an impact applied to the rear surface of the substrate.

25. The primer according to claim 24, wherein the layers of metal oxide and reducing metal further comprise:

a primary ignition portion comprising layers of metal oxide and reducing metal in closer proximity to the substrate; and a secondary ignition portion comprising layers of metal oxide and reducing metal that are farther from the substrate than the primary ignition portion, the thickness of each of the layers of metal oxide and reducing metal within the secondary ignition portion being greater than the thickness of each of the layers of metal oxide and reducing metal within the primary ignition portion.

26. The primer according to claim 24, wherein the thickness of each layer is generally proportional to a distance between each layer and the substrate.

27. A primer, comprising:

a substrate having a deposition surface and a rear surface, the substrate being structured to be dented upon impact by a conventional firing pin for a conventional firearm;

alternating layers of metal oxide and reducing metal deposited upon the substrate, at least some of the alternating layers of metal oxide and reducing metal having expansion or contraction stresses therebetween;

an interface between each metal oxide layer and adjacent reducing metal layer, the interface being either substantially free of metal oxide, or the interface being a reducing metal oxide layer having a thickness of less than 2 nm; and the alternating layers of metal oxide and reducing metal being structured to react with each other in response to an impact applied to the rear surface of the substrate.

28. The primer according to claim 21, further comprising a passivation layer covering the layers of metal oxide and reducing metal.

29. A primer, comprising:

a substrate having a deposition surface and a rear surface, the substrate having a beveled edge defining a shelf extending around a periphery of the primer, the substrate being structured to be dented upon impact by a conventional firing pin for a conventional firearm;

alternating layers of metal oxide and reducing metal deposited upon the substrate;

an interface between each metal oxide layer and adjacent reducing metal layer, the interface being either substantially free of metal oxide, or the interface being a reducing metal oxide layer having a thickness of less than 2 nm; and the alternating layers of metal oxide and reducing metal being structured to react with each other in response to an impact applied to the rear surface of the substrate.

30. The primer according to claim 1, wherein the substrate is made from brass or copper.

31. The primer according to claim 30, wherein the substrate has a thickness of about 0.005 inch to about 0.1 inch.

32. The primer according to claim 31, wherein the substrate has a thickness of about 0.01 to about 0.025 inch.

33. The primer according to claim 1, wherein the substrate has a thickness of about 0.005 inch to about 0.1 inch.

34. The primer according to claim 33, wherein the substrate has a thickness of about 0.01 to about 0.025 inch.

35. The primer according to claim 12, wherein the substrate is made from a malleable metal.

36. The primer according to claim 35, wherein the substrate is made from brass or copper.

37. The primer according to claim 36, wherein the substrate has a thickness of about 0.005 inch to about 0.1 inch.

38. The primer according to claim 37, wherein the substrate has a thickness of about 0.01 to about 0.025 inch.

39. The primer according to claim 12, wherein the substrate has a thickness of about 0.005 inch to about 0.1 inch.

40. The primer according to claim 39, wherein the substrate has a thickness of about 0.01 to about 0.025 inch.

41. The primer according to claim 21, wherein the substrate is made from brass or copper.

42. The primer according to claim 41, wherein the substrate has a thickness of about 0.005 inch to about 0.1 inch.

43. The primer according to claim 42, wherein the substrate has a thickness of about 0.01 to about 0.025 inch.

44. The primer according to claim 21, wherein the substrate has a thickness of about 0.005 inch to about 0.1 inch.

45. The primer according to claim 44, wherein the substrate has a thickness of about 0.01 to about 0.025 inch.

46. The primer according to claim 1, further comprising zirconium disposed within the primer.

47. The primer according to claim 21, further comprising zirconium disposed within the primer.

* * * * *